United States Patent [19]

Harmatuik

[11] Patent Number: 4,817,253

[45] Date of Patent: Apr. 4, 1989

[54] CARD HOLDING DEVICE

[76] Inventor: Rodney I. Harmatuik, 105-145 King Edward St., Coquitlam, British Columbia, Canada

[21] Appl. No.: 110,920

[22] Filed: Oct. 20, 1987

[51] Int. Cl.[4] ..... A44B 21/00; A45C 13/00

[52] U.S. Cl. ..... 24/458; 24/328; 150/137; 40/390

[58] Field of Search ..... 24/458, 328, 370, 570; 40/390, 403, 400, 405, 530, 533; 150/137, 150

[56] References Cited

U.S. PATENT DOCUMENTS

| | | | |
|---|---|---|---|
| 222,086 | 11/1879 | Slemmer | 24/328 |
| 732,429 | 6/1903 | Napp | 40/400 |
| 1,119,925 | 12/1914 | Chatham | 40/400 |
| 1,287,374 | 12/1918 | Manown | 40/390 |
| 2,149,978 | 3/1939 | Noel | 40/533 |
| 2,357,320 | 9/1944 | Fruitman | 40/390 |
| 2,650,594 | 9/1953 | Heilman | 40/405 |
| 2,752,707 | 7/1956 | King | 40/400 |
| 3,062,364 | 11/1962 | Ziemski | 150/137 |
| 3,416,586 | 12/1968 | Voss | 24/328 |
| 3,911,605 | 10/1975 | Morhack | 40/405 |

*Primary Examiner*—Victor N. Sakran

*Attorney, Agent, or Firm*—Townsend & Townsend

[57] ABSTRACT

A card holding device comprising a hinge member having grasping members rotatably mounted along the length of the hinge member. Each of the grasping members has a hinge mounting portion and a pair of spaced, opposed gripping arms separated by a distance less than the thickness of an appropriate card. The gripping arms are sufficiently flexible to allow the edge of a card to be inserted between the arms whereupon the arms exert a clamping force to grasp and hold the card firmly in place.

9 Claims, 2 Drawing Sheets

CARD HOLDING DEVICE

This invention relates to a card holding device for organizing credit cards or like material.

BACKGROUND OF THE INVENTION

Many people today find it necessary to carry a variety of plastic cards in order to funciton efficiently including credit cards, a driver's licence, membership cards to various organizations, and other cards containing personal data. Numerous methods and devices have been developed to hold and organize these plastic cards in wallets and purses including plastic pockets and pocket areas in a wallet or purse. Other devices are disclosed in U.S. Pat. No. 3,416,586 to Voss which describes a money or card-carrying device with a hinge and wire clips for holding items and U.S. Pat. No. 2,137,429 also to Voss which discloses a money or card holder comprising a helical spring where items to be held are inserted between the coils of the spring. With the prior art devices, it is often difficult to locate a card quickly.

The present invention is a card-holding device comprising a hinge member having a plurality of grasping members rotatably mount along the length of the hinge member, each of said grasping members having a hinge mounting portion and a pair of spaced, opposed gripping arms separated by a distance less than the thickness of an appropriate card, said gripping arms being sufficiently flexible to allow the edge of a card to be inserted between the arms whereupon the arms exert a clamping force to grasp and hold the card firmly in place.

In another embodiment, the present invention comprises a hinge member with an attached C-shaped holding portion rotatable about the axis of the hinge having a continuous groove formed about the inner perimeter of the C whereby a plurality of cards can be slid into said groove such that the cards are held along three edges.

The present invention holds plastic or other cards securely and so that they can be easily inspected and selected for use.

The various embodiments of the present invention find particular application in organizing plastic or other cards in a wallet, billfold or purse, but may also be used in briefcases or attached to a car visor.

DESCRIPTION OF THE DRAWINGS

Embodiments of the present invention are illustrated in the following drawings in which:

Referring to FIG. 1, there is shown a preferred embodiment of the present invention comprising a hinge 10 about which are rotatably mounted a series of grasping members 12. Grasping members 12 are formed from spring steel bent into an L-shaped form, the vertical portions 15 of the L being of different lengths for different grasping members and the horizontal portions 17 comprising a pair of spaced, opposed arms 18 and 20. As shown FIGS. 1 and 2, the grasping members 12 are arranged along the hinge 10 such that vertical portion 15 of each subsequent grasping member as one moves along the hinge from one end to the other is shorter than the previous grasping member creating a staircase effect. In this manner, the spaced, opposed arms of each grasping member are located in their own horizontal plane. Plastic cards 25 are inserted between the spaced, opposed arms 18 and 20 which firmly grasp a corner of the card and allow the cards to be stacked. Cards can be positioned so that they do not completely coverlap as shown in FIG. 2 in order that they can be quickly identified and removed from the holder. Grasping members 12 can be rotated about the axis of the hinge 10 so covered cards can be examined.

A further embodiment of the present invention incorporates the staircase arrangement of the previously-described embodiment that is repeated twice along the length of the hinge so that two sets of spaced, opposed arms 18 and 20 are located in a horizontal plane, the two sets being spaced along the length of the hinge so as to grab opposite corners along the length of the same card.

Figure 3:
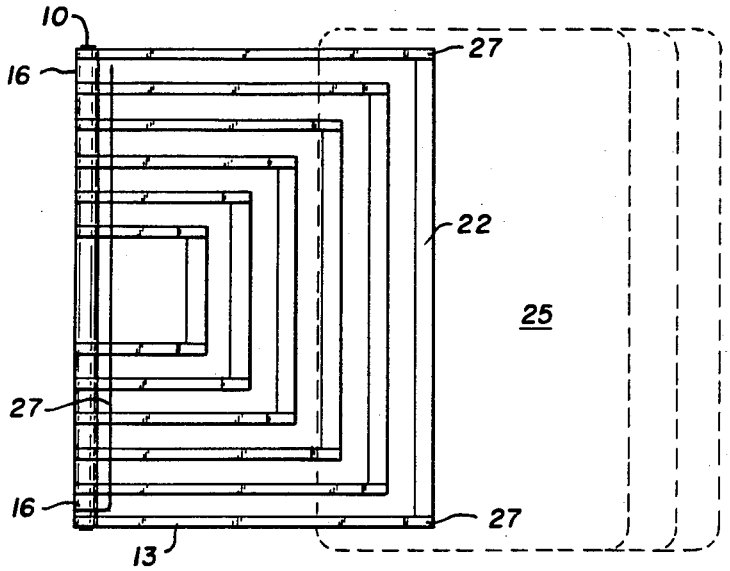
FIG. 3 shows a plan view of a second embodiment of the present invention.
Figure 4:
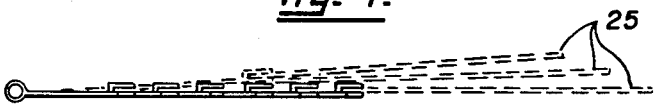
FIG. 4 shows an edge of view of the embodiment of FIG. 3.

FIGS. 3 and 4 illustrate a still further embodiment of the present invention. Hinge 10 supports a plurality of U-shaped grasping members 13. Each grasping member 13 is rotatably attached to hinge member 10 by the parallel arms of the U, each arm terminating in attachment point 16. The spanning member 22 which joins the parallel arms is formed with grasping element 27 at the junction of the spanning member and the parallel arms. As best shown in FIG. 3, each U-shaped member 13 has progressively smaller dimensions, so that the member can fit within the interior of a larger member.

Figure 5:
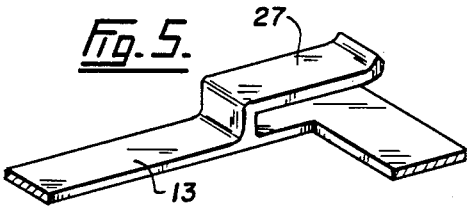
FIG. 5 is a close-up of the gripping arms used with the second embodiment.

FIG. 5 is a detailed view of grasping element 27 equivalent to the spaced, opposed arms of the previous embodiment.

Cards 25 are inserted between the arms of the grasping element which tightly grips the edges of the card. As shown in FIGS. 3 and 4, the cards are held so that they do not overlap entirely so that they can be easily viewed and selected. Scissor spring 27 extends through the arms of the U-shaped grasping members 13 to ensure that the members tend to lie flat in a single plane. Grasping members 13 can be rotated about hinge 10 to view the stacked cards and scissor spring 27 will cause the device to close.

Figure 6:
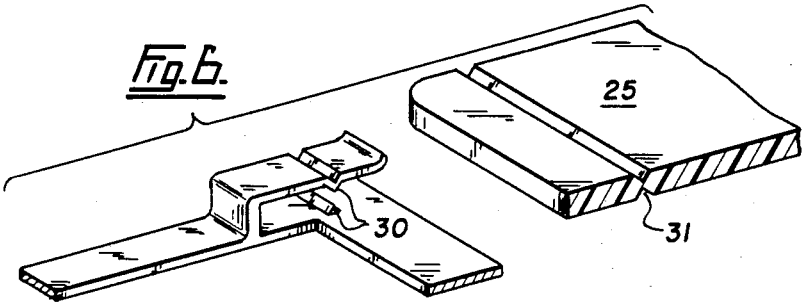
FIG. 6 is a close-up of another embodiment of the gripping arms.

As a further modification, grasping element 27 can be formed with internal notches 30 to engage a groove 31 in a suitably modified card 25. Such an embodiment is illustrated in FIG. 6.

Figure 1:
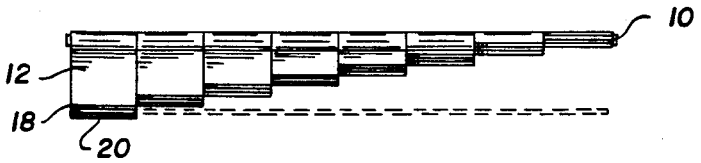
FIG. 1 is a side view of a preferred embodiment of the present invention.
Figure 2:
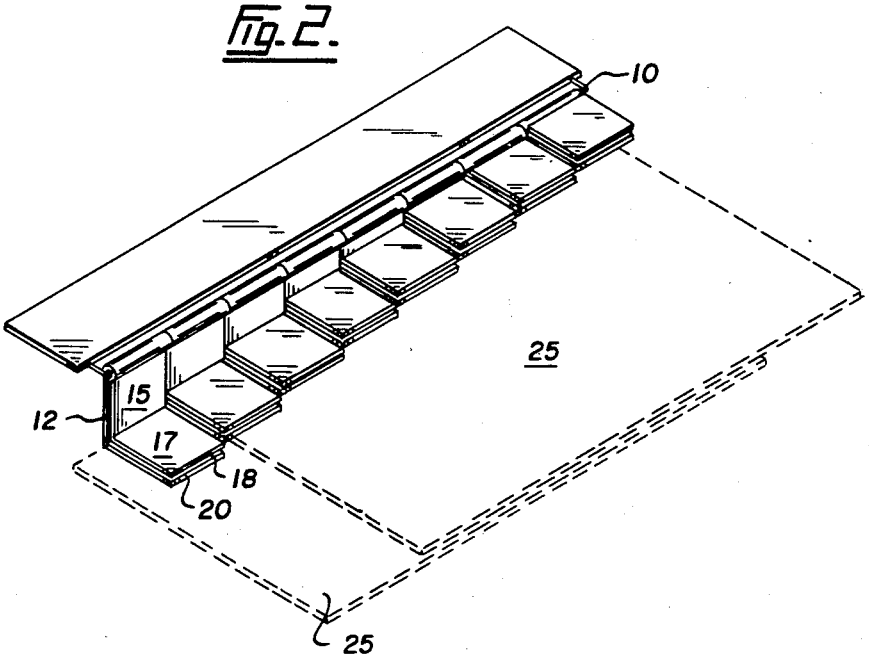
FIG. 2 is a pictorial view of the embodiment of FIG. 1.
Figure 7:
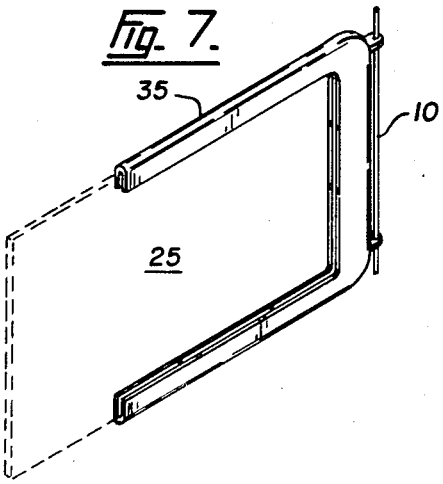
FIG. 7 is a pictorial view of a third embodiment of the present invention.

A still further embodiment of the present device is shown in FIG. 7 and comprises a C-shaped member 35 rotatably mounted about a hinge 10. The internal edges of the C-shaped member are grooved to accept and hold a card 25 along three edges as shown in FIG. 7. A plurality of C-shaped member 35 can be mounted about hinge 10.

In all the above-mentioned embodiments, a rectangular tab can be rotatably attached to hinge 10, said tab being inserted into a suitable pocket in a wallet or purse to locate the present invention within the wallet or purse.

I claim:

1. A card holding device comprising a hinge member having a plurality of grasping members rotatably mounted along the length of the hinge member, each of said grasping members having a hinge mounting portion and a card receiving portion comprising a clip having a pair of spaced, opposed gripping arms separated by a distance less than the thickness of an appropriate card, said gripping arms being sufficiently flexible to allow the edge of a card to be inserted betweeen the arms whereupon the arms exert a clamping force to grasp and hold the card firmly in place.

2. A card holding device as claimed in claim 1 in which said grasping members are formed with a depending portion connecting the hinge-mounting portion and the card receiving portion, said depending portions being of different lengths on different grasping members, and said grasping members being arranged along the hinge member in a step-like pattern such that the depending portion of the next grasping member is shorter than the previous grasping member as one moves down the hinge from one end to the other, this arrangement placing each pair of spaced, opposed gripping arms at different levels to hold individual cards in different planes.

3. A card holding device as claimed in claim 2 in which the step-like pattern of grasping members is repeated twice along the length of the hinge member such that each card receiving portion of a first grasping member has a corresponding card receiving portion spaced further along the length of the hinge and attached to a second grasping member thereby allowing the first and second grasping members to grasp a card at two points along the same length of the card.

4. A credit card holder as claimed in claim 1 including a tongue member attached to said hinge member for insertion into a wallet pocket in order to retain the present device in a wallet.

5. A card holding device as claimed in claim 1 in which said gripping arms are formed with ridges to engage a suitably-formed groove in a card in order to securely hold the card.

6. A card holding device comprising a hinge member having a plurality of grasping members rotatably mounted along the length of the hinge member, each of said grasping members being a U-shaped member having two parallel arms and a spanning arm extending therebetween to define an interior region, said U-shaped member being connected to said hinge member by said parallel arms and rotatable about the axis of the hinge, having spaced, opposed gripping arms formed on the spanning arm connecting said two parallel arms, each of said U-shaped members being progressively smaller in size and fitting within the interior region of the previous U-shaped member.

7. A card holding device as claimed in claim 6 in which said gripping arms are formed in two pairs along the length of the spanning arm in order to grasp a card at two points along the same length.

8. A card holding device as claimed in claim 6 in which said U-shaped members are held in the same plane by a scissor spring.

9. A card holding device as claimed in claim 6 in which said gripping arms are formed with ridges to engage a suitably-formed groove in a credit card in order to securely hold the card.

* * * * *